US007845638B2

(12) United States Patent
Wiens et al.

(10) Patent No.: US 7,845,638 B2
(45) Date of Patent: Dec. 7, 2010

(54) FEEDER ASSEMBLY FOR LASER IMAGING APPARATUS

(75) Inventors: Curt A. Wiens, Oakdale, MN (US); Chris Zwettler, Stillwater, MN (US); Hoa Pham, Woodbury, MN (US)

(73) Assignee: Carestream Health, Inc., Rochester, NY (US)

( * ) Notice: Subject to any disclaimer, the term of this patent is extended or adjusted under 35 U.S.C. 154(b) by 801 days.

(21) Appl. No.: 11/619,734

(22) Filed: Jan. 4, 2007

(65) Prior Publication Data

US 2008/0164650 A1 Jul. 10, 2008

(51) Int. Cl.
*B65H 5/00* (2006.01)

(52) U.S. Cl. ..... 271/264; 271/273

(58) Field of Classification Search ..... 271/264, 271/273

See application file for complete search history.

(56) References Cited

U.S. PATENT DOCUMENTS

| | | | | |
|---|---|---|---|---|
| 3,532,423 | A | 10/1970 | Bruning et al. | |
| 4,526,464 | A | 7/1985 | Milillo | |
| 4,754,144 | A | 6/1988 | Seto | |
| 5,253,941 | A | 10/1993 | Kamoda | |
| 6,007,971 | A | 12/1999 | Star et al. | |
| 6,475,709 | B2 | 11/2002 | Strijckers et al. | |
| 6,712,357 | B1 * | 3/2004 | Tranquilla | 271/273 |
| 6,825,864 | B2 | 11/2004 | Botten et al. | |
| 2003/0047862 | A1 * | 3/2003 | Komatsu | 271/10.01 |
| 2004/0169325 | A1 | 9/2004 | Nelson | |
| 2005/0151823 | A1 | 7/2005 | Botten et al. | |
| 2005/0192181 | A1 * | 9/2005 | Ikemizu et al. | 503/227 |
| 2005/0250057 | A1 * | 11/2005 | Goto | 430/348 |
| 2006/0046209 | A1 * | 3/2006 | Kimura et al. | 430/348 |

FOREIGN PATENT DOCUMENTS

| | | |
|---|---|---|
| DE | 19636235 | 3/1998 |
| EP | 0 480 454 A2 | 4/1992 |
| EP | 1 708 021 A1 | 10/2006 |

* cited by examiner

*Primary Examiner*—Saúl J Rodríguez
*Assistant Examiner*—Howard Sanders

(57) ABSTRACT

An imaging apparatus including a media source having a plurality of sheets of photothermographic imaging media contained therein, an exposure unit including an input engagement point, an output engagement point, and a laser module positioned therebetween, and a driven roller pair forming a nip. A driven roller pair is configured to receive a leading edge of a sheet from a media source and is configured to begin extracting the sheet from the media source and driving the sheet along a transport path extending from the media source to at least the output engagement point of the exposure unit. Upon the leading edge being engaged by the input engagement point, the nip is configured to open while the trailing edge of sheet is still within the media source such that a remaining portion of the sheet is extracted from the media source by the exposure unit while the laser module exposes a desired image on the sheet.

10 Claims, 9 Drawing Sheets

FEEDER ASSEMBLY FOR LASER IMAGING APPARATUS

FIELD OF THE INVENTION

The invention relates generally to the field of imaging, and in particular to a laser imaging apparatus. More specifically, the invention relates to a laser imaging apparatus with a feeder assembly enabling exposure of a sheet of photothermographic imaging media simultaneous with extraction of the sheet from a media supply.

BACKGROUND OF THE INVENTION

Laser imagers are widely used in the medical imaging field to produce visual representations on film of digital medical images. Laser imagers typical include a media supply system, a feeder system, an exposure system, a processing system, an output system (e.g. output tray, sorter), and a transport system that moves film through the laser imager along a transport path from the media supply system to the output system. The media supply system generally includes a supply of sheets of photothermographic media stacked in one or more cassettes or trays and a pickup assembly for removing individual sheets from the cassettes for delivery to the feeder assembly.

Laser imagers have typically segregated the functions of extracting film sheets from the cassettes, exposing the extracted sheet, and processing or developing the exposed sheet. In order to provide faster time to first image and increased film throughput, some laser imaging systems are now designed so as to begin processing a sheet while it is still being exposed, a so-called processing-while-imaging system. However, to avoid sheet disturbances associated with the extraction of sheets from the cassettes from impacting image quality, conventional laser imagers continue to separate the extraction process from the exposure process.

While such systems may have achieved certain degrees of success in their particular applications, there is a need to provide an improved system and method for decreasing time to first image and increasing film throughput in laser imaging systems employing photothermographic imaging media.

SUMMARY OF THE INVENTION

An object of the present invention is to provide a feeder assembly that enables exposure of a sheet of photothermographic imaging media simultaneous with extraction of the sheet from a media supply.

Another object of the present invention is to shorten a length of a transport path from a media supply to an exposure system so as to decrease time to first image.

These objects are given only by way of illustrative example, and such objects may be exemplary of one or more embodiments of the invention. Other desirable objectives and advantages inherently achieved by the disclosed invention may occur or become apparent to those skilled in the art. The invention is defined by the appended claims.

According to one aspect of the invention, there is provided an imaging apparatus including a media source having a plurality of sheets of photothermographic imaging media contained therein, an exposure unit including an input engagement point, an output engagement point, and a laser module positioned therebetween, and a driven roller pair forming a nip. The driven roller pair is configured to receive a leading edge of a sheet from the media source and configured to begin extracting the sheet from the media source and driving the sheet along a transport path extending from the media source to at least the output engagement point of the exposure unit, the transport path having a length less than a transport direction length of the sheet; wherein upon the leading edge being engaged by the input engagement point the nip is configured to open while trailing edge of the sheet is still within the media source such that a remaining portion of the sheet is extracted from the media source by the exposure unit while the laser module exposes a desired image on the sheet.

According to one aspect of the invention, the driven roller pair is configured to transport the sheet at a first transport rate along a first portion of the transport path between the driven roller pair and the input engagement point, wherein the first rate is greater than a transport rate of the exposure unit, and to slow transport of the sheet from the first transport rate to a second transport rate along a remaining portion of the transport path between the driven roller pair and the input engagement point as the leading edge approaches the input engagement point along the transport path, wherein the second transport rate is substantially equal to the transport rate of the exposure unit.

According to one aspect of the invention, the imaging apparatus includes a curved media guide positioned between the driven roller pair and the exposure unit and forming a portion of the transport path, the media guide having a first end positioned proximate the driven roller pair and a second end positioned proximate the exposure unit and configured to direct the sheet from the driven roller pair to the input engagement point.

According to one aspect of the invention, the driven roller pair comprises a drive roller and an idler roller between a closed position at which the idler roller forms the nip with the drive roller and an open position at which the idler roller is spaced from the drive roller and the nip is opened.

According to one aspect of the invention, a stationary idler roller is positioned between the driven roller pair and the input engagement point such that the sheet transitions from following the media guide to traveling over a surface of the stationary idler roller after the leading edge is engaged by the input engagement point.

According to one aspect of the invention, the stationary idler roller is positioned to form a desired angle between horizontal and a position line extending from a first point of contact of the sheet with a surface of the stationary idler roller through an endpoint of the first end of the media guide.

According to one aspect of the invention, the moveable idler roller is positioned between the first end of the media guide and the media source such that a center of the moveable idler roller is positioned so as not to be above the position line when the moveable idler roller is in the open position, wherein the first end of the media guide is defined as being below the position line.

BRIEF DESCRIPTION OF THE DRAWINGS

The foregoing and other objects, features, and advantages of the invention will be apparent from the following more particular description of the embodiments of the invention, as illustrated in the accompanying drawings. The elements of the drawings are not necessarily to scale relative to each other.

DETAILED DESCRIPTION OF THE INVENTION

Figure 1:
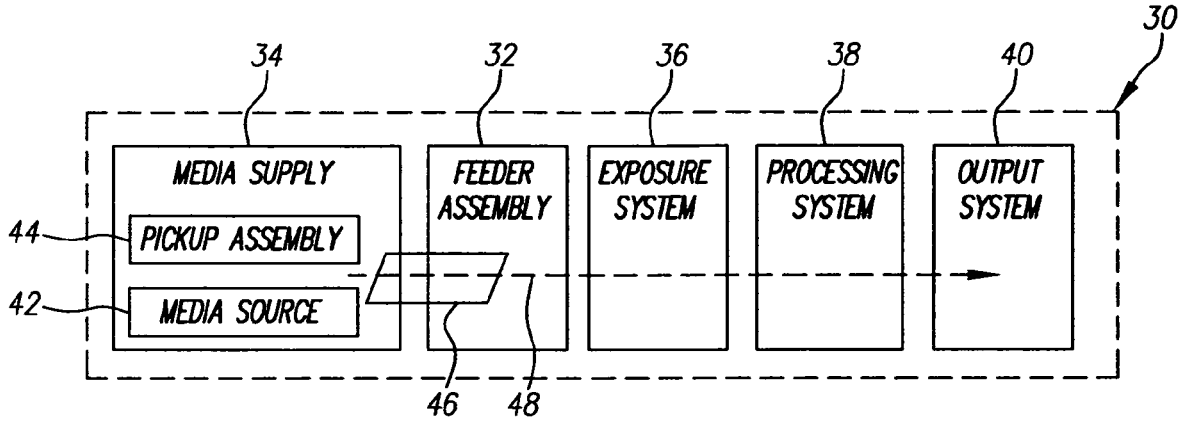
FIG. 1 shows a block diagram illustrating an example of an imaging apparatus employing a feeder assembly according to the present invention.

The following is a detailed description of the preferred embodiments of the invention, reference being made to drawings in which the same reference numerals identify the same elements of structure in each of the several figures.

FIG. 1 is a block diagram illustrating generally an example of a laser imaging apparatus 30 employing a feeder assembly 32, according to embodiments of the present invention, which, as will be described in greater detail below, enables laser exposure of a sheet of photothermographic imaging media to be simultaneous with the sheet's extraction from a media source. In addition to feeder assembly 32, laser imaging apparatus 30 includes a media supply system 34, a laser exposure system 36, a processing system 38, and an output system 40. Media supply system 34 further includes a media source 42 and a pickup assembly 44. In one embodiment, media source 42 comprises a media cassette containing a stack of sheets of unexposed photothermographic imaging media.

Pickup assembly 44 is configured to remove an individual sheet of photothermographic imaging media, such as sheet 46, from media cassette 42. Feeder assembly 32 is configured to receive and deliver sheet 46 from pickup assembly 44 to laser exposure system 36 along a transport path 48, wherein a length of transport path 48 from media source 42 to laser exposure system 36 is less than a transport direction length of sheet 46. As will be described in greater detail below, feeder assembly 32 is configured to deliver sheet 46 to laser exposure system 36 in a fashion to substantially minimize disturbances to sheet 46 to enable laser exposure system 36 to begin exposing a desired image on sheet 46 while a portion of sheet 46 is still being extracted from media cassette 42.

Processing system 38 receives exposed sheet 46 from laser exposure system 36 via transport path 48 and develops the latent image formed thereon by laser exposure system 36. In one embodiment, processing system 38 comprises a thermal processor (e.g., a drum-type processor, drum and flatbed type) which heats exposed sheet 46 to thermally develop the latent image. Developed sheet 46 is cooled and moved by processing system 38 to output system 40 (e.g., a tray or sorter system). An example of an imaging apparatus similar to that described above by laser imaging apparatus 30 and suitable to be configured for use with feeder assembly 32 according to embodiments of the present invention is described by U.S. Pat. No. 6,007,971 to Star et al., which is herein incorporated by reference.

Figure 2:
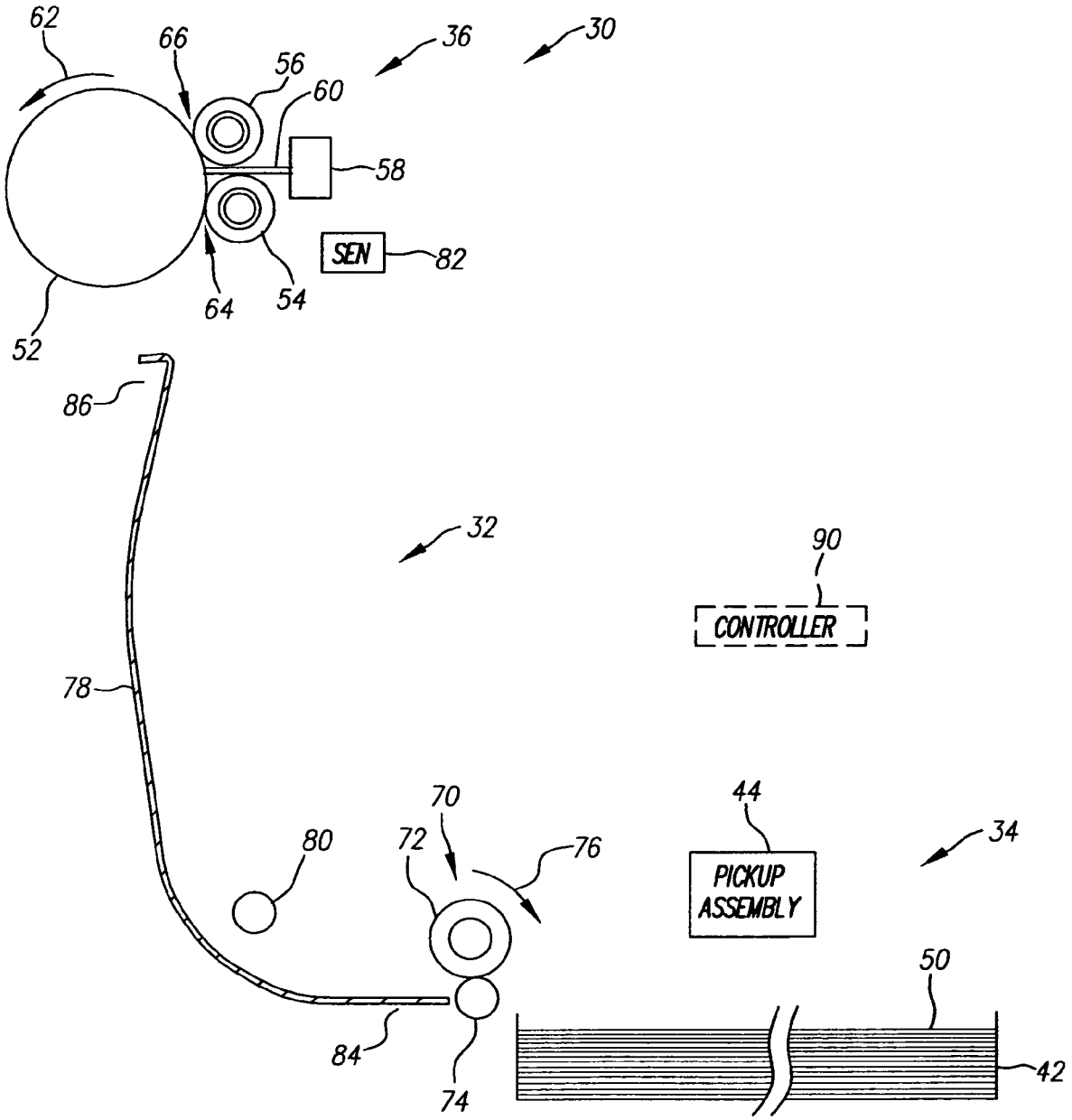
FIG. 2 shows a block and schematic diagram of one embodiment of a feeder assembly according to the present invention.

FIG. 2 is a block and schematic diagram illustrating portions of laser imaging apparatus 30 including media supply system 34, laser exposure system 36, and one embodiment of feeder assembly 32 according to embodiments of the present invention. Media supply system 34 includes media cassette 42, containing a stack 50 of sheets of photothermographic imaging media, and pickup assembly 44. Laser exposure system 36 includes a rotating exposure roller 52, first and second pressure rollers 54 and 56, each of which is biased against exposure roller 52, and a laser scanning module 58 that provides a light beam 60 which is modulated based on image data (e.g., digital or analog) to form a latent image of a desired photographic image on sheet of photothermographic imaging media as it passes between and is held against exposure roller 52 by first and second pressure rollers 54 and 56. In one embodiment, exposure roller 52 is driven in a direction as indicated by directional arrow 62 at an transport rate, R1, so as to transport a sheet of photothermographic imaging media from an input engagement point 64 formed by exposure roller 52 and first pressure roller 54 to an output engagement point 66 formed by exposure roller 52 and second pressure roller 56 and past light beam 60 of laser scanning module 58.

Feeder assembly 32 includes a roller pair 70, including a drive roller 72 and an idler roller 74, with idler roller 74 being moveable between a "closed" position and an "open" position. With respect to FIG. 2, moveable idler roller 74 is illustrated in the closed position. When in the closed position, moveable idler roller 74 forms a nip with drive roller 72. In one embodiment, drive roller 72 is driven in a direction as indicated by directional arrow 76 at a transport rate, R2. In one embodiment, drive roller 72 has an exterior surface comprising silicone foam. In one embodiment, the silicone foam comprises a medium density silicone foam. In one embodiment, moveable idler roller 74 has an exterior surface comprising stainless steel. Feeder assembly 32 further includes a media guide 78, a non-moveable or stationary idler roller 80, and a sensor 82 positioned and configured to monitor movement of first pressure roller 54 away from exposure roller 52 of laser exposure system 36. In one embodiment, stationary idler roller 80 has an exterior surface comprising stainless steel. In one embodiment, stationary idler roller 80 comprises an idler wheel assembly comprising a plurality of low-inertia idler wheels spaced along and able to independently rotate about a shaft, such as the idler wheel assembly described by U.S. patent application Ser. No. 11/502,095 entitled "IMAGING APPARATUS WITH TRANSPORT SYSTEM EMPLOYING SNAP-ON IDLER WHEEL", and which is assigned to the same assignee as the present invention and is incorporated herein by reference.

Media guide 78 has a first end 84 positioned proximate to and configured to receive a sheet of photothermographic imaging media from roller pair 70. Media guide 78 is curved so as to direct a sheet of photothermographic imaging media from cassette 42 to laser exposure system 36, with a second end 86 of media guide 78 being positioned and angled so as to direct a leading edge of a sheet of photothermographic imaging media to an input engagement point 64 of laser exposure system 36 between exposure roller 52 and first pressure roller 54. In one embodiment, media guide 78 comprises polished stainless steel.

A controller 90 is configured to control actuation of moveable idler roller 74 between the open and closed position. In one embodiment, as will be described in greater detail below, controller 90 is configured to adjust transport rate, R2, at which drive roller 72 is driven. While controller 90 may be included as component of feeder assembly 32, in one embodiment, as illustrated by the dashed lines of FIG. 2, controller 90 is a component of laser imaging apparatus 30 and is separate from feeder assembly 32 and, as known in the art, is configured to control any number of processes and components associated with the operation of laser imaging apparatus 30.

Figure 3A:
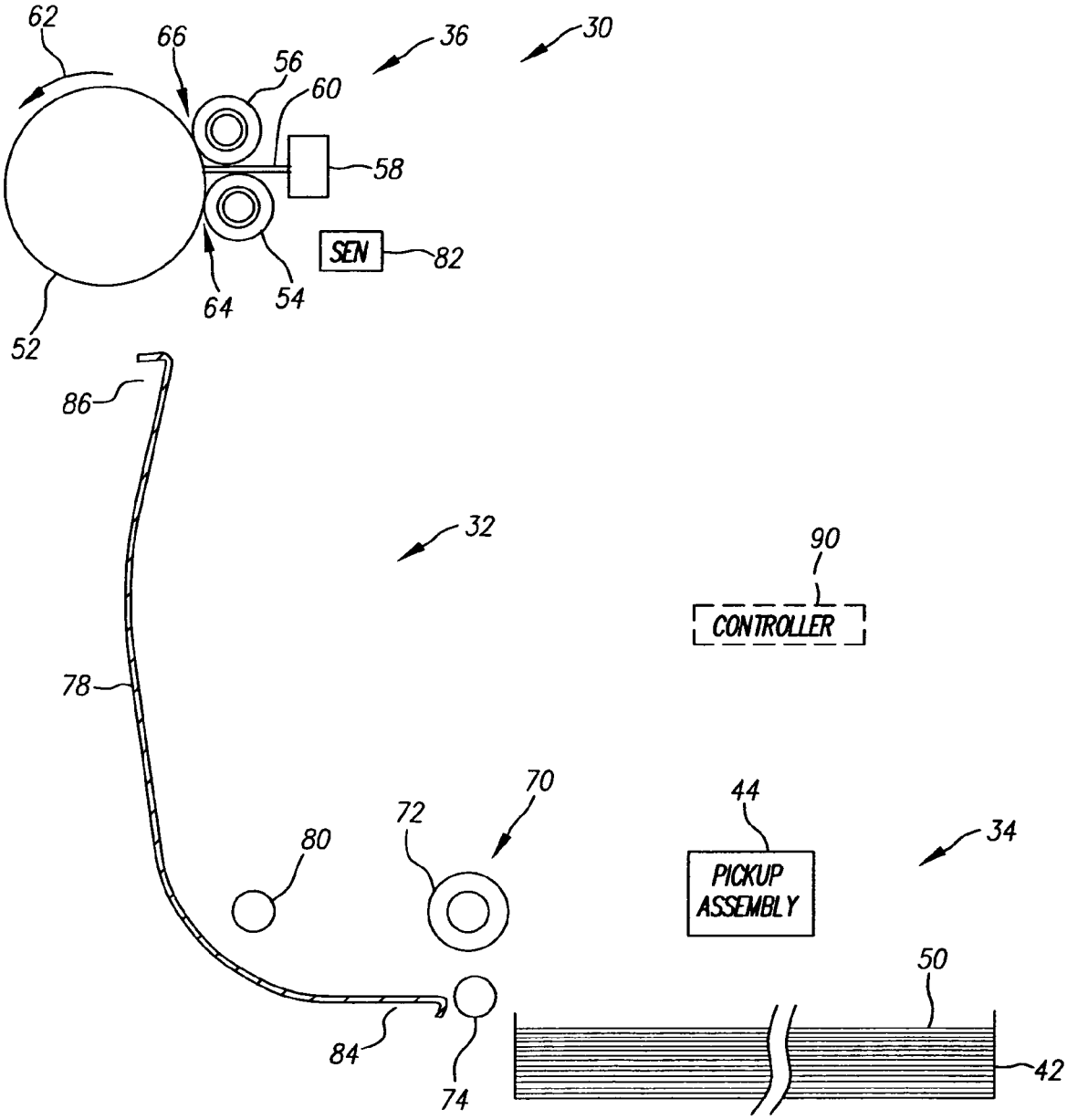
FIGS. 3A-3G show block and schematic diagrams illustrating an example of the operation of the feeder assembly of FIG. 2.
Figure 3B:
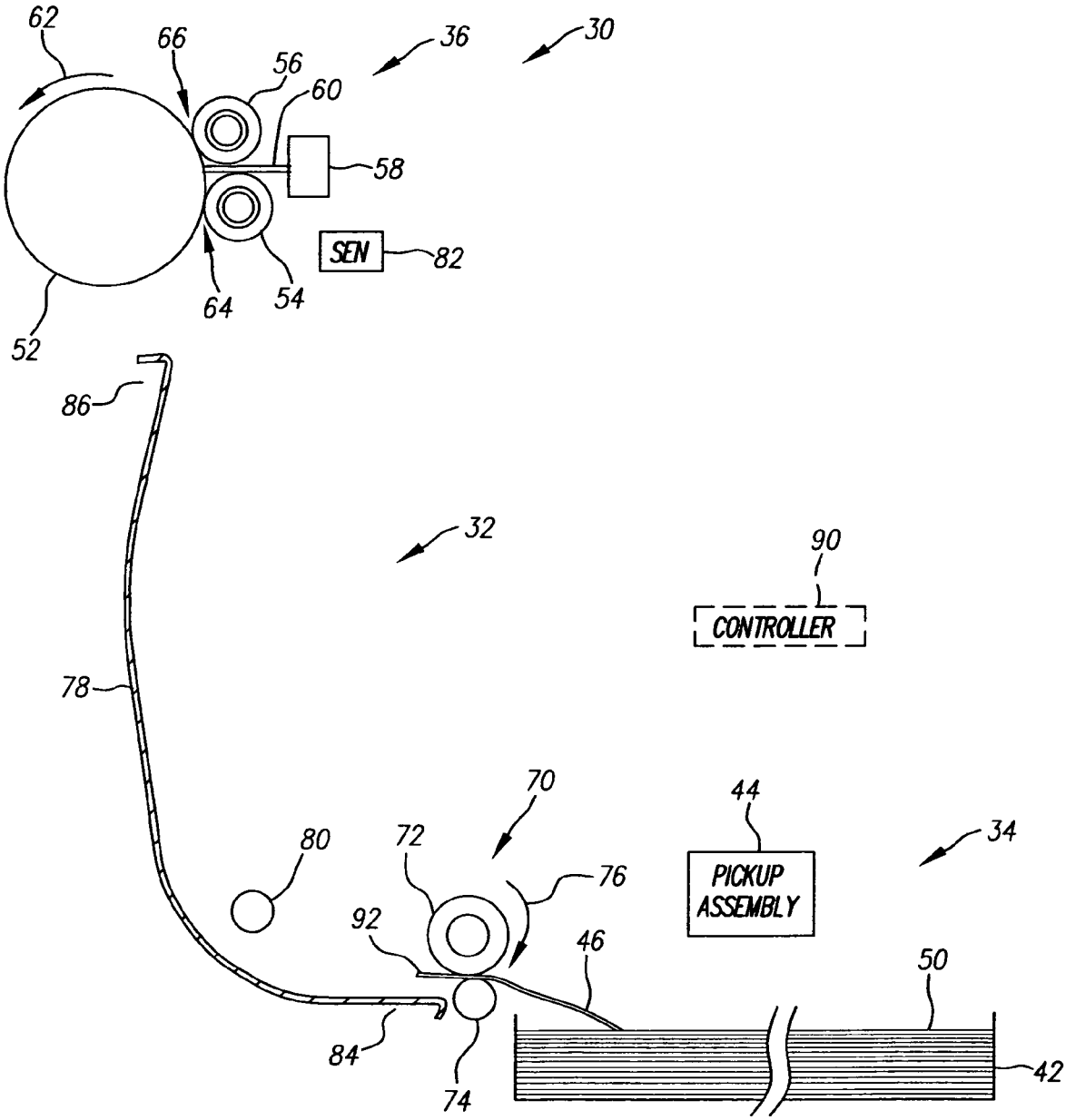

An example of the operation of feeder assembly 32 is described below by FIGS. 3A through 3G. Initially, as illustrated by FIG. 3A, drive roller 72 is not driven and moveable idler roller 74 is in the open position such that the nip between drive roller 72 and moveable idler roller 74 is open. With reference to FIG. 3B, pickup assembly 44 is configured to engage and remove a top sheet of photothermographic imaging media, such as sheet 46, from stack 50 of media cassette 42 and position a leading edge 92 of sheet 46 in the open nip of roller pair 70. An example of a pickup assembly suitable for use as pickup assembly 44 is described by U.S. Patent Publication No. 2004/0169325 to Nelson, filed on Feb. 28, 2003, which is assigned to the same assignee as the present invention and is herein incorporated by reference. Moveable idler roller 74 is subsequently moved to the closed position so as to close the nip with drive roller 72 and secure sheet 46 therein. Sheet 46 is then disengaged by pickup assembly 44.

Figure 3C:
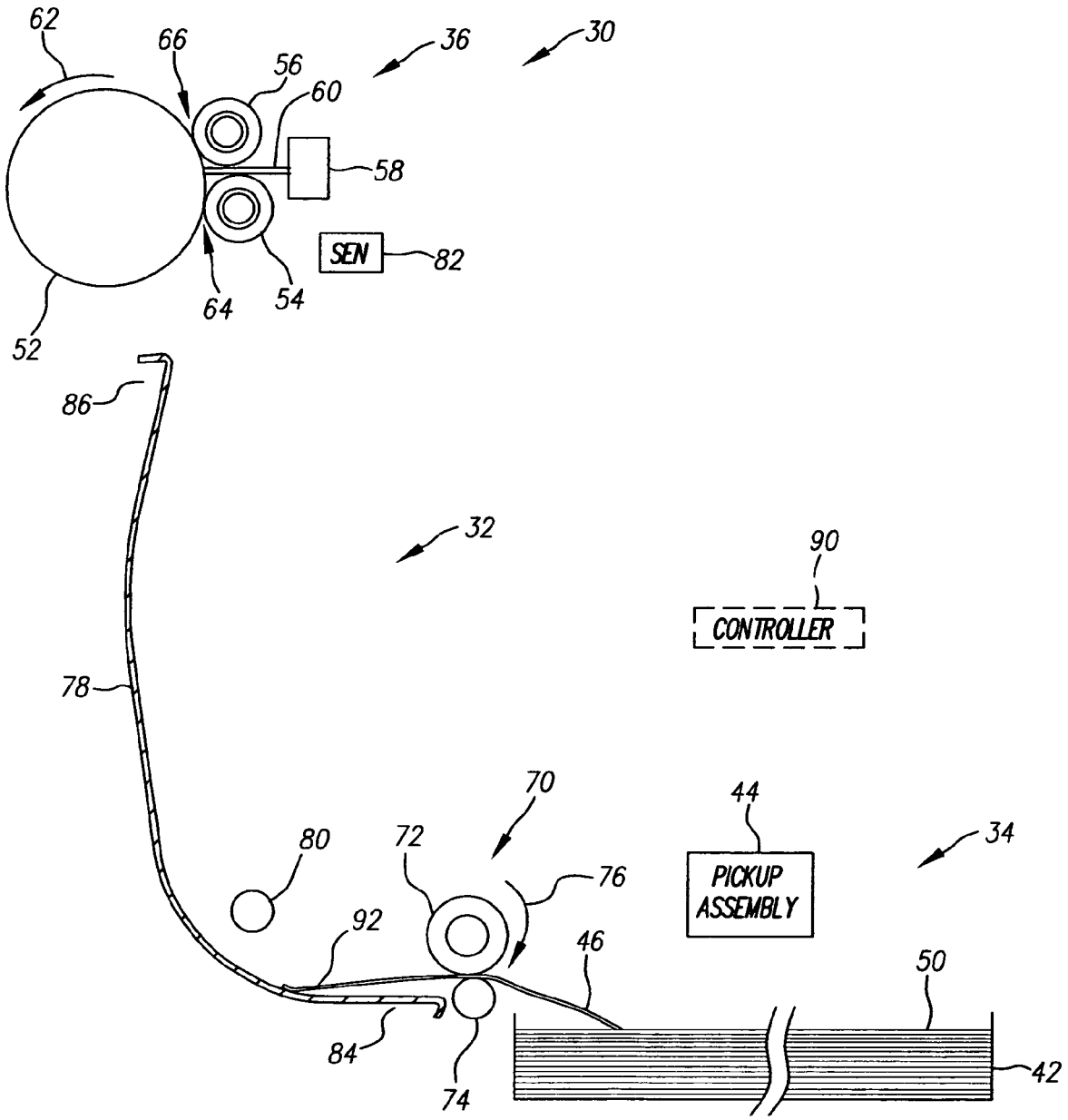

Referring to FIG. 3C, after leading edge 92 of sheet 46 is secured by roller pair 70, drive roller 72 is driven (as indicated by directional arrow 76) and roller pair 70 begins pulling sheet 46 from media cassette 42 and feeding leading edge 92 toward media guide 78. As sheet 46 is pulled/fed from media cassette 42, leading edge 92 contacts and begins following media guide 78 and is driven toward laser exposure system 36 by roller pair 70. It is noted that a length of the transport path from the nip formed by roller pair 70 and along media guide 78 to the point where light beam 60 of laser exposure system 36 exposes a passing sheet is less than a transport direction length of sheet 46.

Figure 3D:
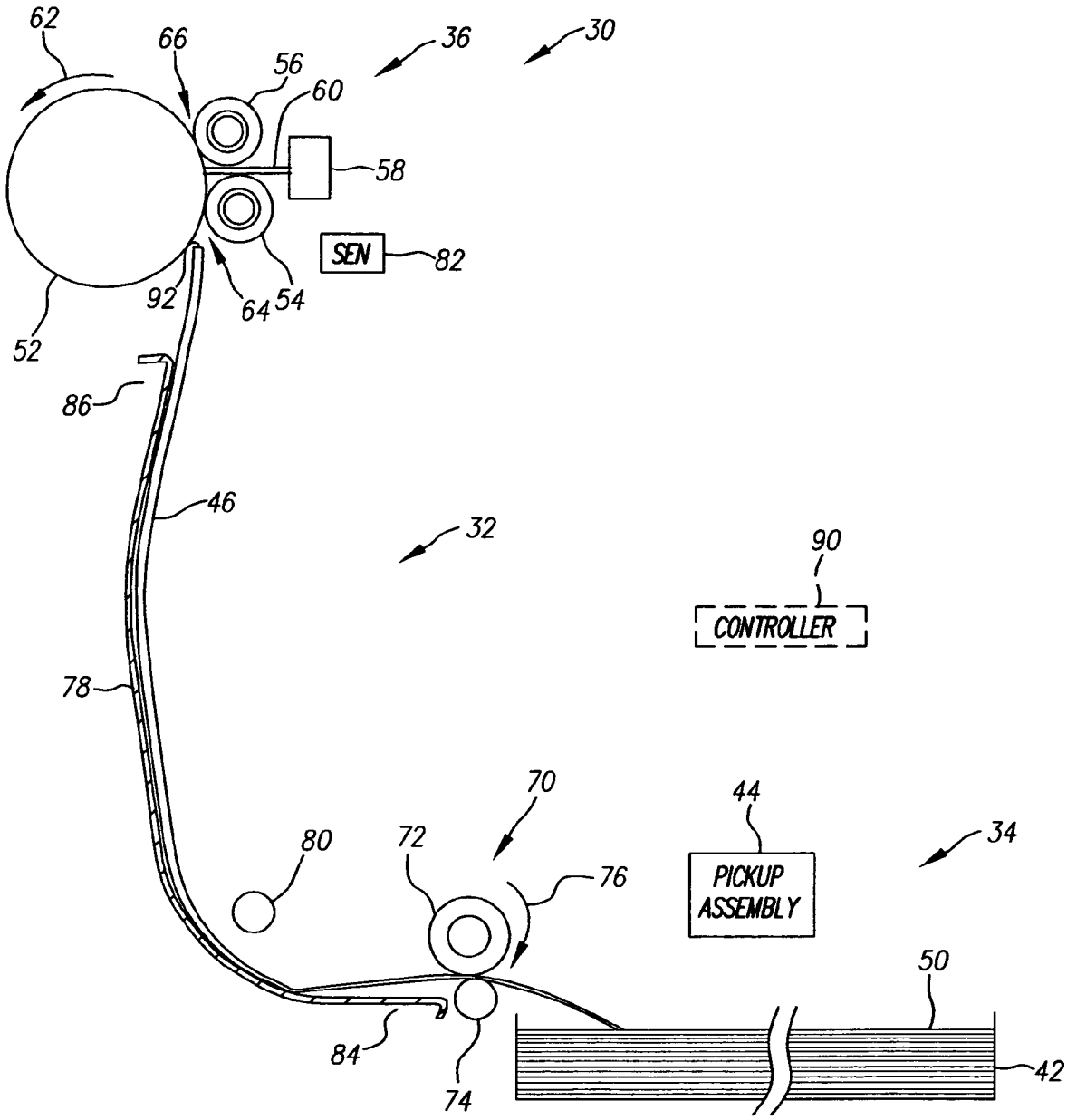

With reference to FIG. 3D, as roller pair 70 continues pulling sheet 46 from cassette 42 and driving sheet 46 along media guide 78, leading edge 92 is directed to input engagement point 64 of laser exposure system 36 by second end 86 of media guide 78. In one embodiment, prior to engagement of leading edge 92 of sheet 46 by input engagement point 64 of laser exposure system 36, transport rate R2 of roller pair 70 is at an initial rate that is greater than transport rate R1 of laser exposure system 36. In one embodiment, based on a length of transport path 48 between roller pair 70 and input engagement point 64, and on the initial transport rate of roller pair 70, controller 90 reduces transport rate R2 of roller pair 70 as leading edge 92 approaches input engagement point 64 such that the adjusted rate substantially matches transport rate R1 of laser exposure system 36.

Operating roller pair 70 at a transport rate R2 which is initially higher that transport rate R1 of laser exposure system 36 reduces the time to first image of laser imaging apparatus 30, while reducing transport rate R2 to match transport rate R1 as leading edge 92 approaches input engagement point 64 reduces the potential for damage to sheet 46 which may be caused by an impact resulting from leading edge 92 "stubbing" into exposure roller 52 and/or first pressure roller 54 as it is engaged by laser exposure system 36.

Figure 3E:
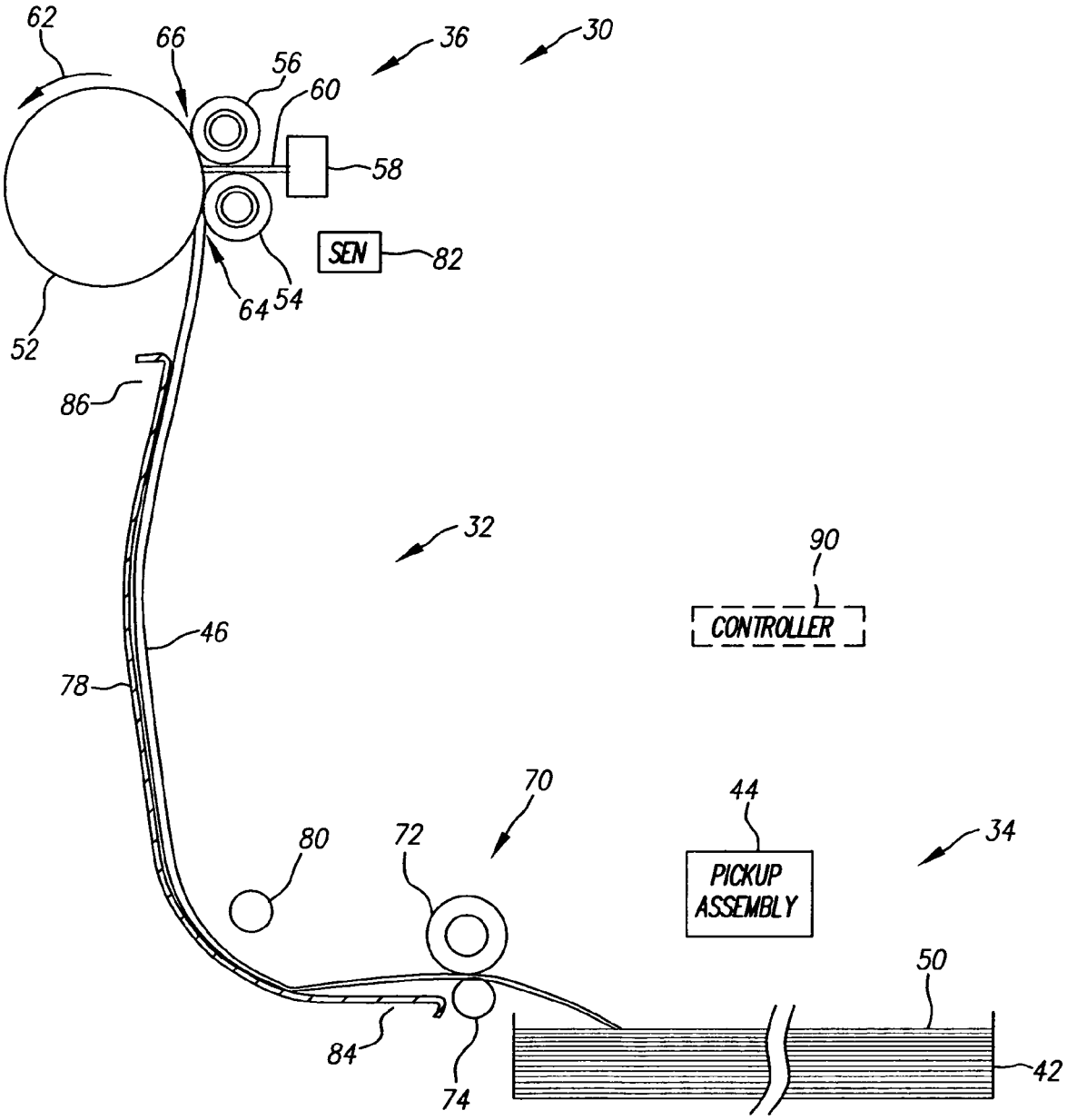

With reference to FIG. 3E, as soon as leading edge 92 of sheet 46 is engaged by input engagement point 64 of laser exposure system 36 and begins to pass between exposure roller 52 and first pressure roller 54, first pressure roller 54 is pushed away from exposure roller 52. Sensor 82 is positioned and configured to detect the movement of first pressure roller 54 away from exposure roller 52. In one embodiment, sensor 82 comprises an infrared type motion sensor. Based on detection of movement of first pressure roller 54 by sensor 82, controller 90 moves moveable idler roller 74 to the "open" position such that sheet 46 is disengaged by roller pair 70. By disengaging sheet 46 from roller pair 70 after engagement by input engagement point 64 and prior to exposure by laser scanning module 58, image artifacts resulting from disturbances that might otherwise be caused by variations in transport rates between feeder assembly 32 and laser exposure system 36 are eliminated.

Figure 3F:
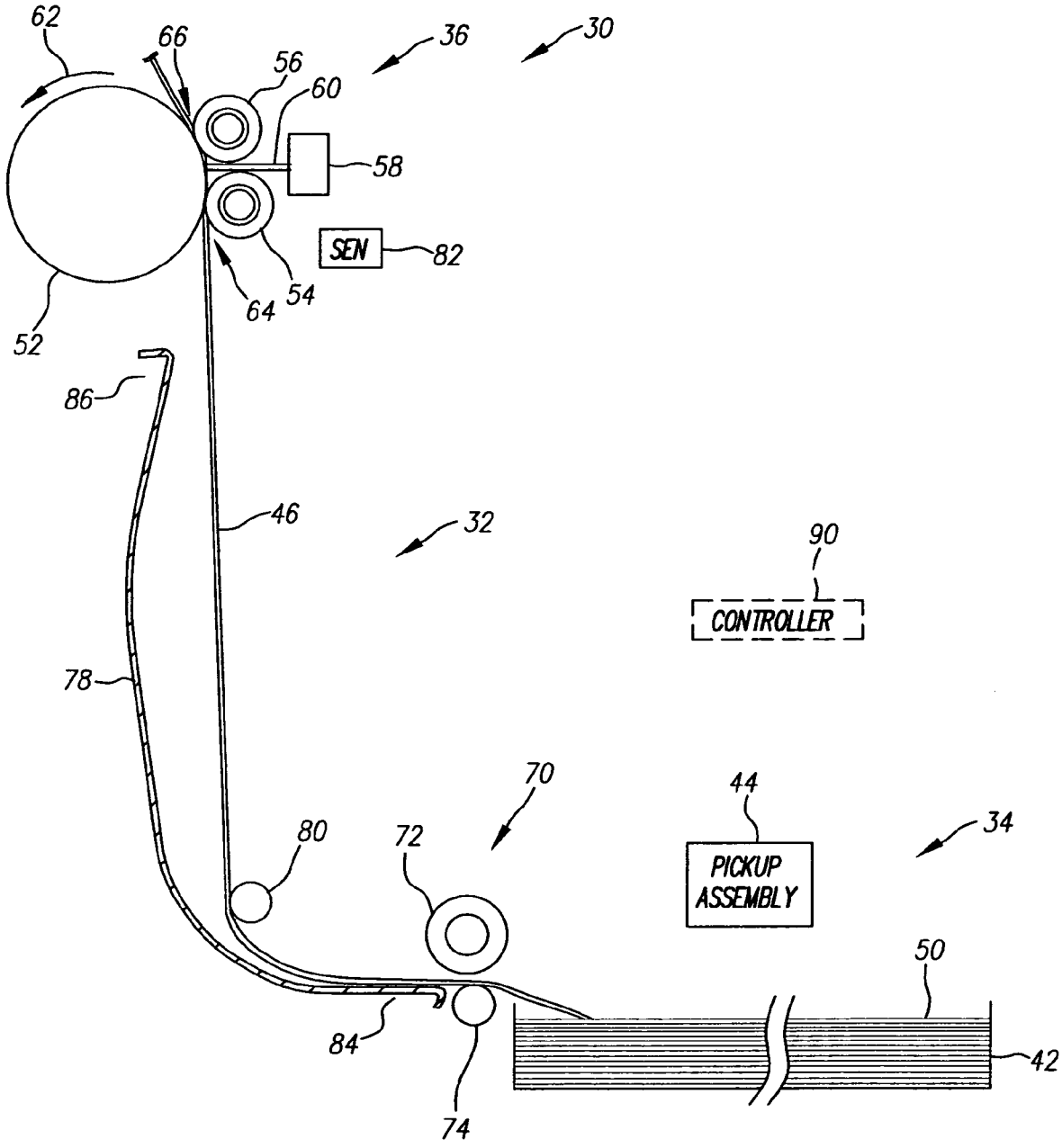

Referring to FIG. 3F, after engagement by input engagement point 64, rotation of exposure roller 52 continues to extract sheet 46 from media cassette 42 and drives leading edge 92 of sheet 46 through output engagement point 66 and toward processing system 38 (see FIG. 1). As sheet 46 passes between first and second pressure rollers 54 and 56, laser scanning module 58 begins exposing a desired latent image on sheet 46 via modulated light beam 60. Also, as exposure roller 52 continues to drive sheet 46 through laser exposure system 36 and toward processing system 38, sheet 46 transitions from traveling along media guide 78 to traveling on a surface of stationary idler roller 80, which rotates as sheet 46 passes. Riding on stationary idler roller 80 in this fashion reduces the potential for disturbances to sheet 46 which might otherwise occur if sheet 46 was sliding on media guide 78, thereby reducing the occurrence of errors in the latent image formed on sheet 46 by laser scanning module 58.

Figure 3G:
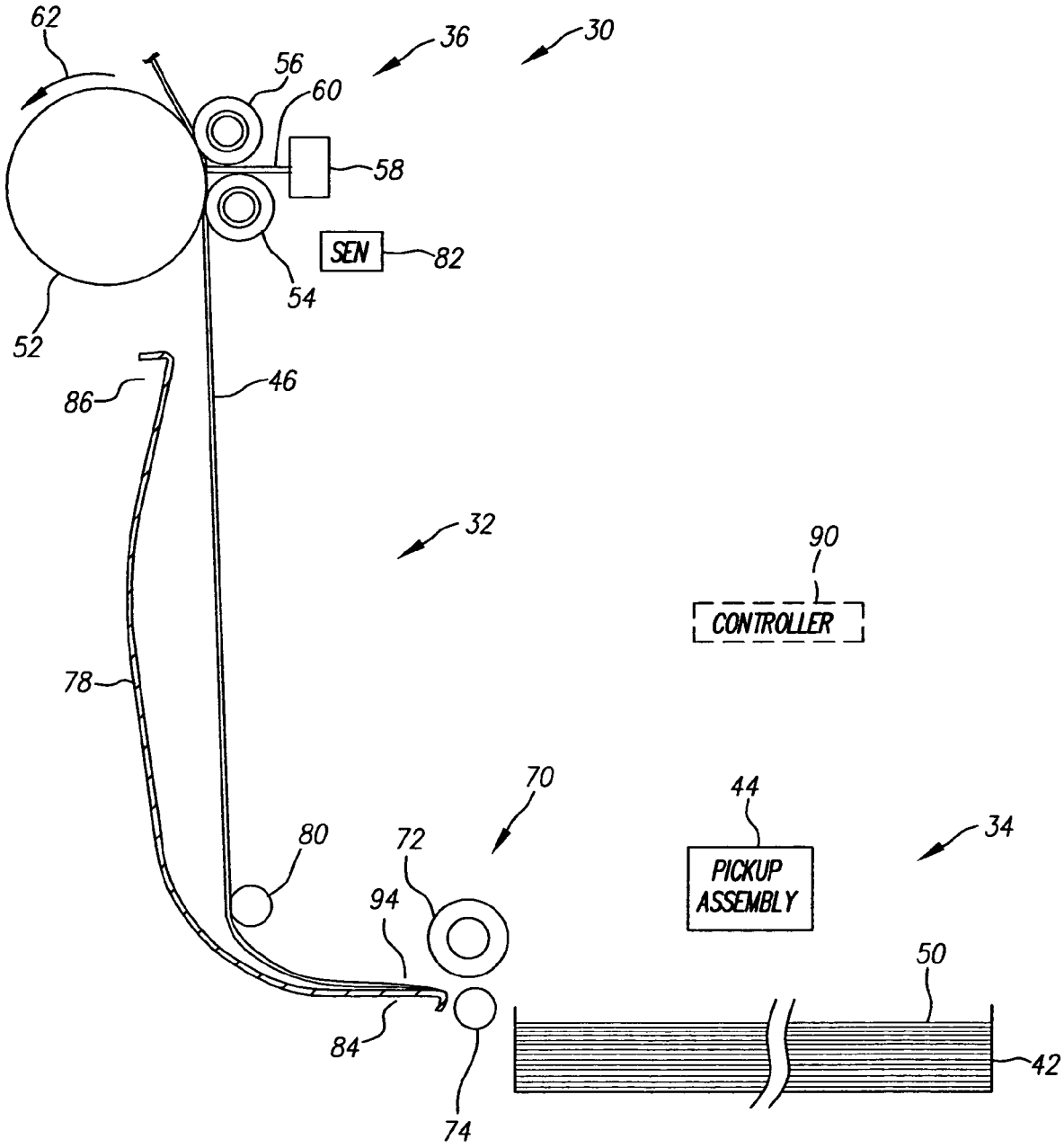

With reference to FIG. 3G, as exposure roller 52 continues to rotate, sheet 46 continues to be extracted from media cassette 42 while being exposed by laser scanning module 58. Eventually, trailing edge 94 of sheet 46 is extracted from media cassette 42, travels over moveable idler roller 74, and transitions to media guide 78. Exposure roller 52 continues transporting sheet 46 past laser scanning module 58 until the desired image is entirely exposed on sheet 46.

Figure 4:
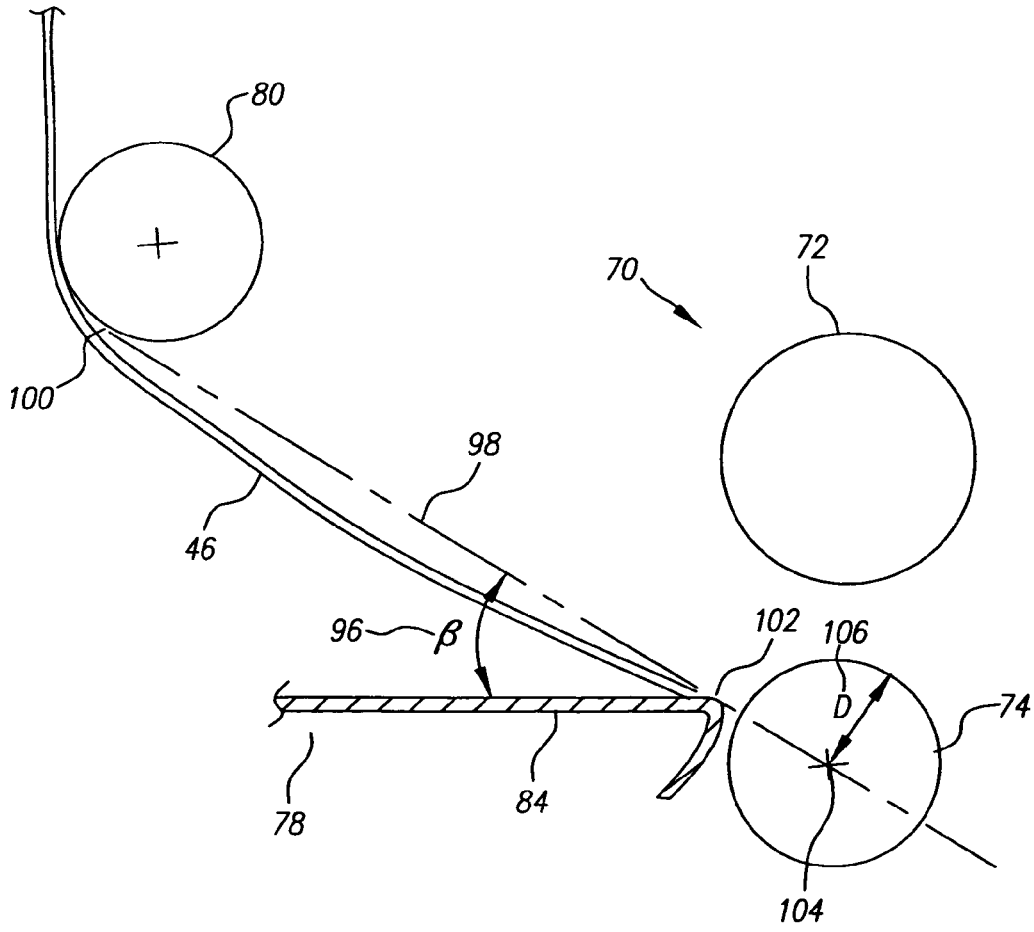
FIG. 4 shows a schematic diagram illustrating portions of the feeder assembly of FIG. 2.

FIG. 4 is a schematic diagram illustrating the position of stationary idler roller 80 with respect to media guide 78 and of moveable idler roller 72 with respect to stationary idler roller 80 and media guide 78. In FIG. 4, moveable idler roller 74 is illustrated in the "open" position with sheet 46 being in a position similar to that of FIG. 3G, where trailing edge 94 has just transitioned from moveable idler roller 74 to first end 84 of media guide 78.

In one embodiment, stationary idler roller 80 is positioned relative to media guide 78 so as to form a desired angle (β) 96 between horizontal and a line 98 (indicated by dashed lines) extending from a point of first contact 100 of sheet 46 with an outer surface of stationary idler roller 80 through an endpoint 102 of first end 84 of media guide 78. In one embodiment, as illustrated by FIG. 4, it is noted that first end 84 of media guide 78 is positioned so as to be substantially horizontal. In other embodiments, first end 84 may be positioned at an angle relative to horizontal.

Due to an elastic nature of sheet 46, a "whip-like" effect of trailing edge 94 transitioning from moveable idler roller 74 to media guide 78 may impart an impact force to sheet 46 which can propagate through sheet 46 to laser exposure system 36 and cause an error in the latent image as it is being exposed on sheet 46 by laser scanning module 58. As such, when in the open position, moveable idler roller 74 is positioned relative to first end 84 so as to provide a smooth transition from moveable idler roller 74 to media guide 78. In one embodiment, when in the open position, moveable idler roller 74 is positioned proximate to endpoint 102 of first end 84 of media guide 78 such that it's center 104 is positioned on or below line 98 so that it's outer surface does not extend a distance D 106 above line 98 that is more than one-half a diameter of moveable idler roller 74. In one embodiment, moveable idler roller 74 has a diameter of approximately 9 millimeters.

To minimize the impact force imparted to sheet 46, the desired angle 96 would be as small as possible. However, the shallower the desired angle 96, the greater the curve which is introduced in sheet 46 as it travels around stationary idler roller 80 and, due to the elastic nature of sheet 46, the harder trailing edge 94 will drag across the surface of media guide 78 as it is pulled by laser exposure system 36, thereby increasing the potential for trailing edge 94 to be scratched or otherwise damaged and for potentially artifact-causing vibrations to propagate through sheet 46 to laser exposure system 36. Additionally, if stationary idler roller 80 is positioned too close to moveable idler roller 74 and to media guide 78, trailing edge 94 may "snap" against media guide 78 as it transitions from moveable idler roller 74.

It is noted that when moveable idler roller 74 is in the closed position, the nip formed with drive roller 72 is positioned above first end 84 of media guide 78 to ensure that leading edge 92 of sheet 46 is fed to and follows media guide 78 and does not inadvertently drop below and fail to follow media guide 78. As such, the greater the desired angle 96, the farther moveable idler roller 74 must travel to reach the open position and the more space which is required for moveable idler roller 74.

As such, stationary idler roller 80 is positioned to form desired angle 96 that reduces both the impact on sheet 46 as it transitions from moveable idler roller 74 to media guide 78 and the drag on trailing edge 94 as sheet 46 is pulled by laser exposure system 36 without requiring a large travel distance for moveable idler roller 74 as it moves between the open and closed positions. In one embodiment, desired angle 96 is in a range of angles approximately between 10-degrees and 40-degrees, with a range between 15-degrees and 25-degrees found as generally being the most effective.

In summary, by disengaging sheet 46 from roller pair 70 after engagement by input engagement point 64 and prior to exposure by laser scanning module 58, image artifacts resulting from disturbances to sheet 46 as it is being exposed by laser scanning module 58 that might otherwise be caused by variations in transport rates between feeder assembly 32 and laser exposure system 36 are eliminated. Additionally, by positioning moveable idler roller 74 relative to media guide 78 and positioning stationary idler roller 80 relative to moveable idler roller 74 and media guide 78 so as to ease the transition of trailing edge 94 of sheet 46 from moveable idler roller 74 to media guide 78, potential disturbances to sheet 46 as it is being exposed by laser scanning module 58 are further reduced. By substantially eliminating potential disturbances to sheet 46 as it is transported between media cassette 42 and laser exposure system 36, feeder assembly 32, according to embodiments of the present invention, enables exposure of sheet 46 (e.g., laser scanning) to be simultaneous with it's extraction from media cassette 42, thereby enabling a length of the transport path to be reduced and the time to first image of laser imaging apparatus 30 to be reduced relative to conventional laser imagers.

A computer program product may include one or more storage medium, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice the method according to the present invention.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

PARTS LIST

30 Laser Imaging Apparatus
32 Feeder Assembly
34 Media Supply System
36 Laser Exposure System
38 Processing System
40 Output system
42 Media Cassette
44 Pickup Assembly
46 Sheet of Photothermographic Imaging Media
48 Transport Path
50 Stack of Sheets of Photothermographic Imaging Media
52 Exposure Roller
54 First Pressure Roller
56 Second Pressure Roller
58 Laser Scanning Module
60 Modulated Light Beam
62 Directional Arrow
64 Input Engagement Point
66 Output Engagement Point
70 Roller Pair
72 Drive Roller
74 Idler Roller
76 Directional Arrow
78 Media Guide
80 Idler Roller
82 Sensor
84 First End of Media Guide
86 Second End of Media Guide
90 Controller
92 Leading Edge of Sheet
94 Trailing Edge of Sheet
96 Desired Angle
98 Line
100 Point of First Contact
102 Endpoint of Media Guide
104 Center of Moveable Idler Roller
106 Distance D

What is claimed is:

1. A method of operating a laser imaging apparatus, the method comprising:

receiving a leading edge of a sheet of photothermographic imaging media in a nip formed by a roller pair;

driving the roller pair so as to begin extracting the sheet from a media source and driving the sheet along a transport path toward an input engagement point of a laser exposure unit, wherein a length of the transport path is less than a transport direction length of the sheet, wherein the roller pair includes a drive roller and a moveable idler roller;

opening the nip formed by the roller pair upon engagement of the leading edge of the sheet by the input engagement point, wherein opening the nip includes moving the idler roller from a closed position where the idler roller forms the nip with the drive roller to an open position where the idler roller is spaced from the drive roller;

positioning a media guide between the roller pair and the laser exposure unit to form a portion of the transport path and to direct the leading edge from the roller pair to the input engagement point, wherein a first end of the media guide is positioned proximate to the roller pair;

positioning a stationary idler roller between the driven roller pair and the input engagement point such that the sheet transitions from following the media guide to traveling over a surface of the stationary idler roller after the leading edge is engaged by the input engagement point; and extracting a remaining portion of the sheet from the media source by pulling the sheet along the transport path via at least the input engagement point of the laser exposure unit while simultaneously exposing a desired image on the sheet.

2. The method of claim 1, wherein a surface of the drive roller comprises a silicone foam material.

3. The method of claim 1, wherein a surface of the moveable idler roller comprises stainless steel.

4. The method of claim 1, wherein the input engagement point comprises a driven exposure roller and a non-driven pressure roller biased toward the driven exposure roller, and wherein the method further comprises moving the non-driven pressure roller away away from the driven exposure roller upon engagement of the leading edge of the sheet.

5. The method of claim 4, further includes configuring a sensor to detect movement of the non-driven pressure roller away from the driven exposure roller, and opening the nip upon detection of rotation of the non-driven pressure roller by the sensor.

6. The method of claim 5, wherein the sensor comprises an infrared sensor.

7. The method of claim 1, including:

driving the roller pair at a first transport rate which is greater than a transport rate of the laser exposure unit prior to the leading edge of the sheet being engaged by the input engagement point; and reducing a transport rate of the roller pair from the first transport rate to a second transport rate which is substantially equal to the transport rate of the exposure unit as the leading edge of the sheet approaches the input engagement point of the laser exposure unit.

8. The method of claim 1, wherein positioning the stationary idler roller includes positioning the stationary idler roller such that a desired angle is formed between horizontal and a position line extending from a first point of contact of the sheet with a surface of the stationary idler roller through an endpoint of the first end of the media guide.

9. The method of claim 8, wherein the moveable idler roller is positioned between the first end of the media guide and the media source such that a center of the moveable idler roller is positioned so as not to be above the position line when the moveable idler roller is in the open position, wherein the first end of the media guide is defined as being below the position line.

10. The method of claim 8, wherein the desired angle is in a range from ten degrees to forty degrees.

* * * * *